US009756887B1

(12) United States Patent
Lucio

(10) Patent No.: US 9,756,887 B1
(45) Date of Patent: Sep. 12, 2017

(54) REVERSIBLE HAT

(71) Applicant: Lucio Enterprises Inc., Miami, FL (US)

(72) Inventor: Dak Lucio, Miami, FL (US)

( * ) Notice: Subject to any disclaimer, the term of this patent is extended or adjusted under 35 U.S.C. 154(b) by 146 days.

(21) Appl. No.: 14/839,380

(22) Filed: Aug. 28, 2015

(51) Int. Cl.

| | |
|---|---|
| ***A42B 1/00*** | (2006.01) |
| ***A42C 5/04*** | (2006.01) |
| ***A42C 5/00*** | (2006.01) |
| ***A61F 9/00*** | (2006.01) |

(52) U.S. Cl.
CPC ..... *A42B 1/006* (2013.01)

(58) Field of Classification Search
CPC ..... A42B 1/205; A42B 1/006; A42B 1/02; A42B 1/04
USPC ..... 2/209.12, 10, 182.1–182.3, 182.6, 171.6, 2/425
See application file for complete search history.

(56) References Cited

U.S. PATENT DOCUMENTS

| | | | | |
|---|---|---|---|---|
| 4,333,180 | A * | 6/1982 | Bay | A42B 3/227 2/10 |
| 5,253,364 | A * | 10/1993 | Robinson | A42B 1/064 2/10 |
| 5,477,629 | A * | 12/1995 | Gleason, Jr. | A42B 1/064 2/DIG. 2 |
| 5,898,935 | A * | 5/1999 | Davis | A42B 1/247 2/10 |
| 6,308,336 | B1 * | 10/2001 | Stephenson | A42B 1/062 2/10 |
| 6,557,180 | B2 | 5/2003 | Hall McKenzie | |
| 2007/0256213 | A1 * | 11/2007 | Dunavin | A42B 1/069 2/171 |

* cited by examiner

*Primary Examiner* — Khaled Annis
*Assistant Examiner* — Timothy K Trieu
(74) *Attorney, Agent, or Firm* — Christian Sanchelima; Jesus Sanchelima

(57) ABSTRACT

A headgear including both a cap crown assembly that can be tucked inside-out and a brim assembly that can be rotated to reverse the headgear without requiring the brim assembly from being completely detached from the cap assembly. The brim assembly includes a spring-loaded pin that allows the visor assembly to rotate 360 degrees until the desired positioning is achieved. A reinforcement assembly maintains the structural integrity of the headgear when the brim is separated from the cap crown assembly during the reversal process.

18 Claims, 18 Drawing Sheets

REVERSIBLE HAT

BACKGROUND OF THE INVENTION

1. Field of the Invention

The present invention relates to a reversible cap and, more particularly, to a reversible cap that does not require a user to completely detach the cap's brim.

2. Description of the Related Art

Several designs for a reversible cap have been designed in the past. None of them, however, include a brim that is securely mounted to a cap at all times, including when the cap and brim are being reversed.

Applicant believes that a related reference corresponds to U.S. Pat. No. 6,557,180 issued to Hall McKenzie Mona for a hat with reversible crown and detachable, reversible visor. However, it differs from the present invention because the Mona reference requires a user to detach the brim from the crown of the cap when reversing it. The present invention maintains the brim mounted to the crown of the cap while the cap's crown is being reversed providing a more secure engagement and eliminating the possibility of the brim being lost.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a hat that includes a brim and crown that are completely reversible.

It is another object of this invention to provide a hat having a brim that can be reversed without requiring detachment from the cap's crown.

It is still another object of the present invention to provide a hat that maintains its structural integrity when the brim is being reversed.

It is another object of the present invention to provide a reversal process that can be applied to a plurality of types of headgear.

It is yet another object of this invention to provide such a hat that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
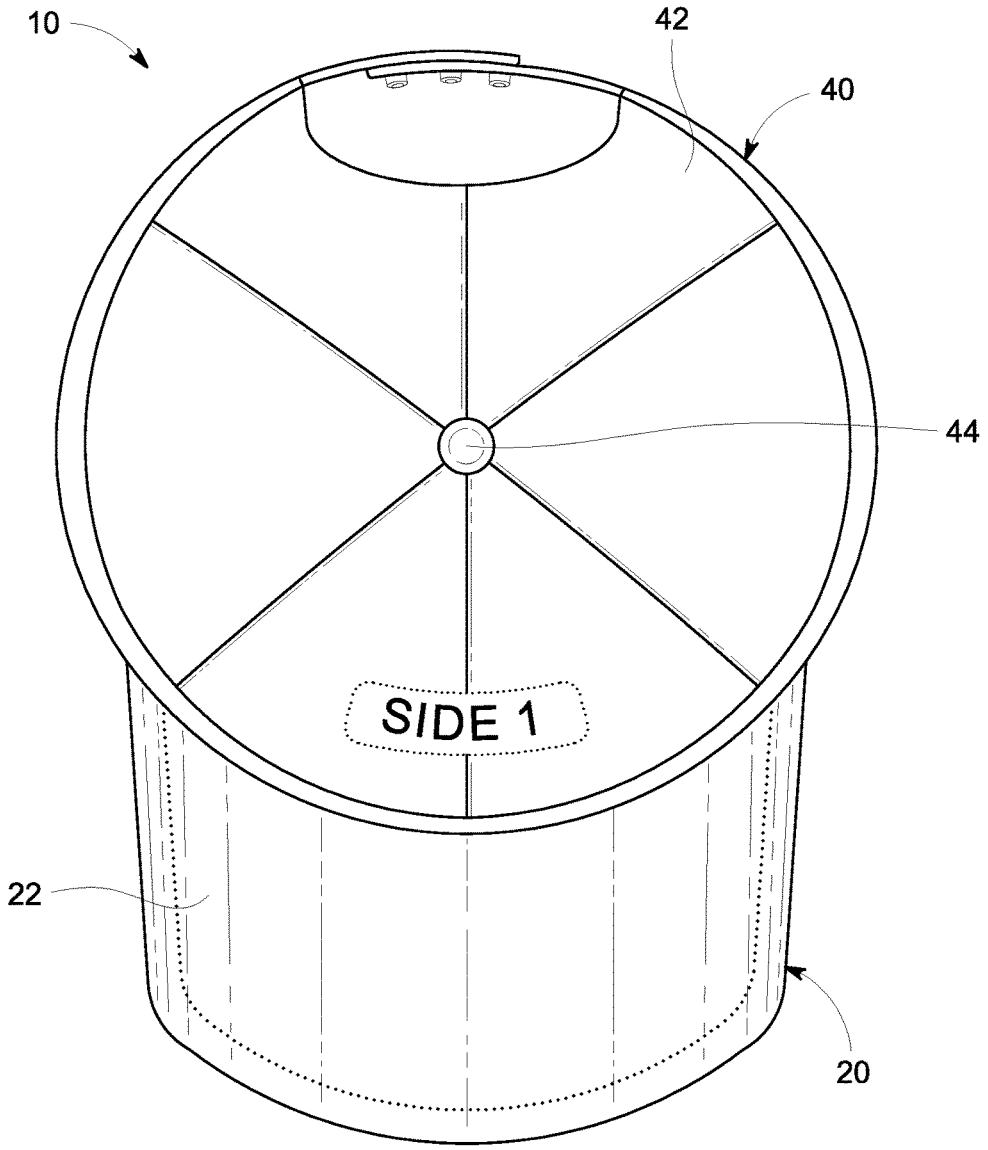
FIG. 1 represents a top view of the present invention showing brim assembly 20 mounted to cap crown assembly 40.
Figure 2:
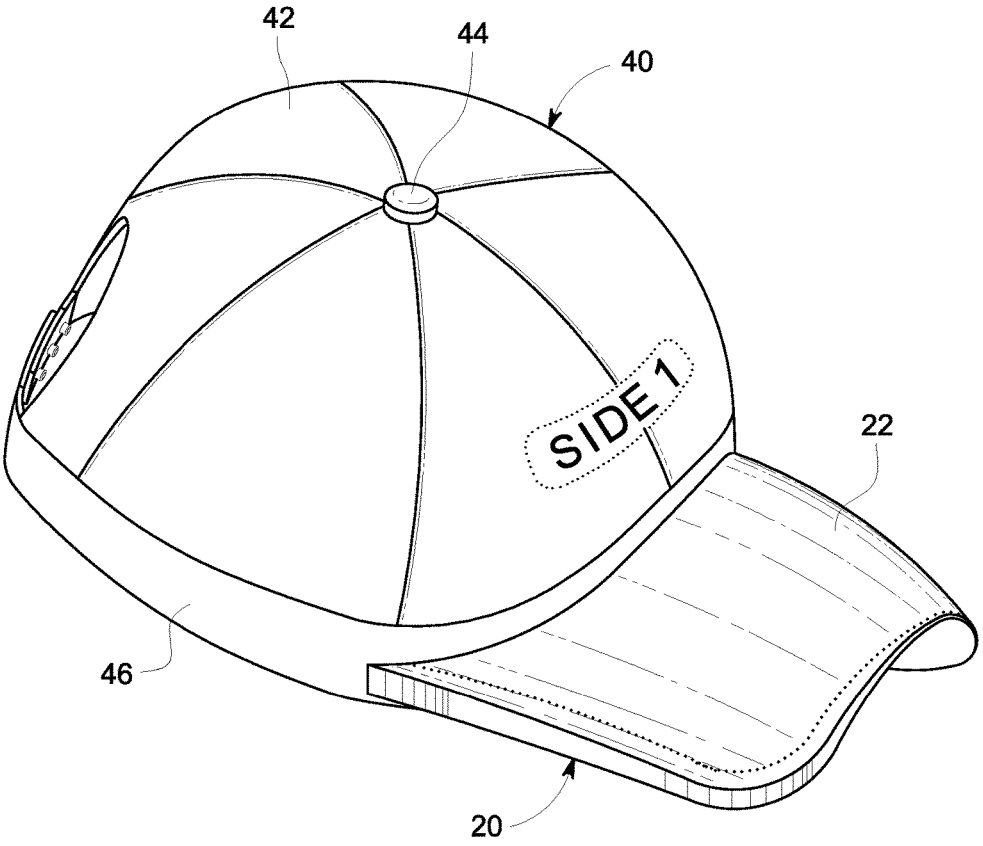
FIG. 2 shows an isometric view of the present invention wherein brim assembly 20 has a curved configuration.
Figure 2A:
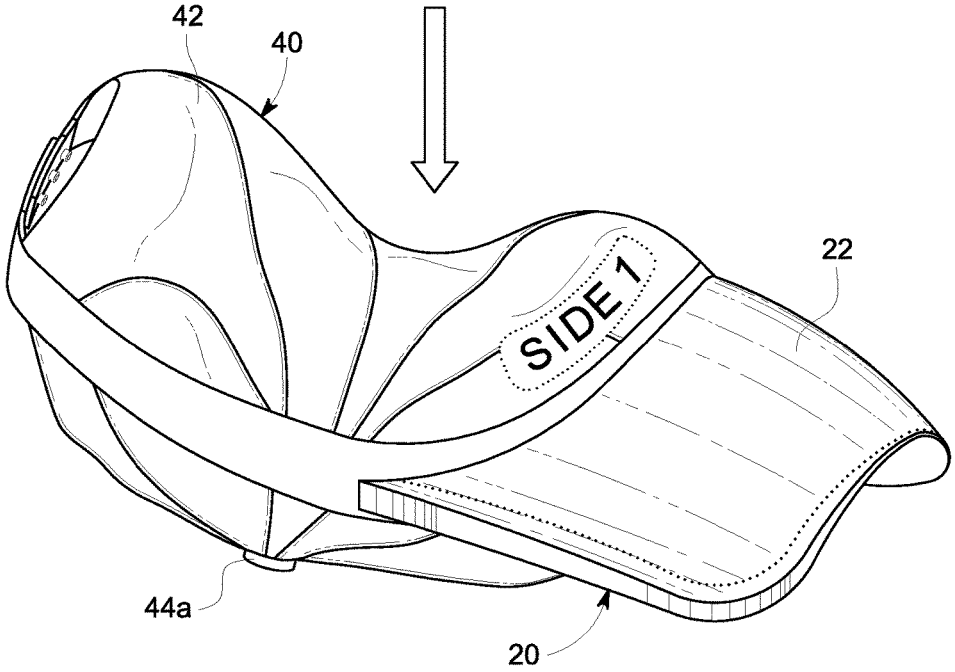
FIG. 2A is an isometric view of the present invention wherein cap crown assembly 40 has begun its reversal process and brim assembly 20 has not been reversed yet.
Figure 2B:
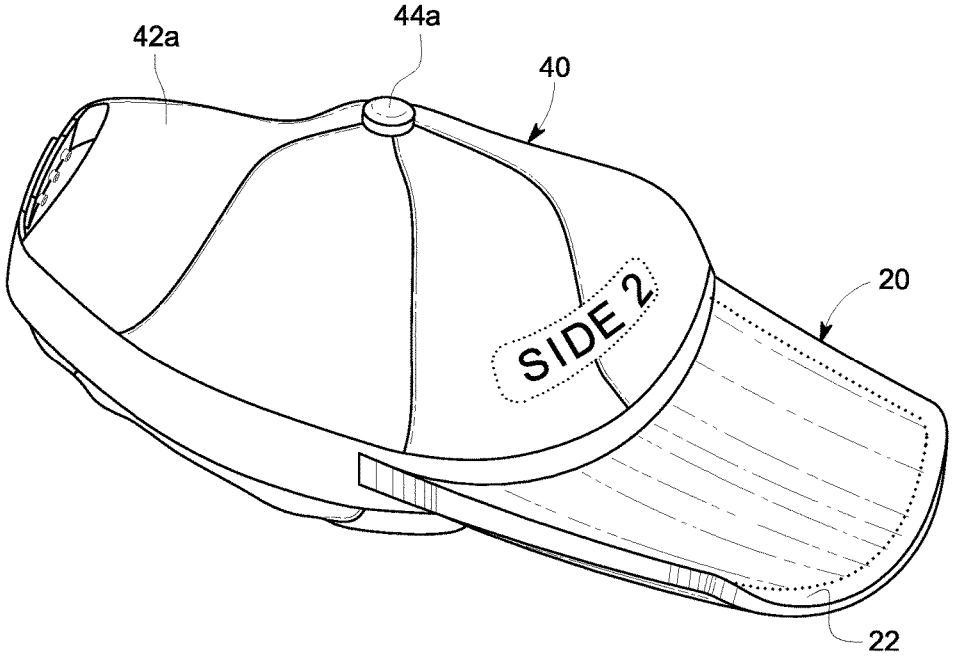
FIG. 2B is an isometric view of the present invention wherein cap crown assembly 40 is shown in the substantially reversed position. Brim assembly 20 has not yet been reversed.
Figure 3:
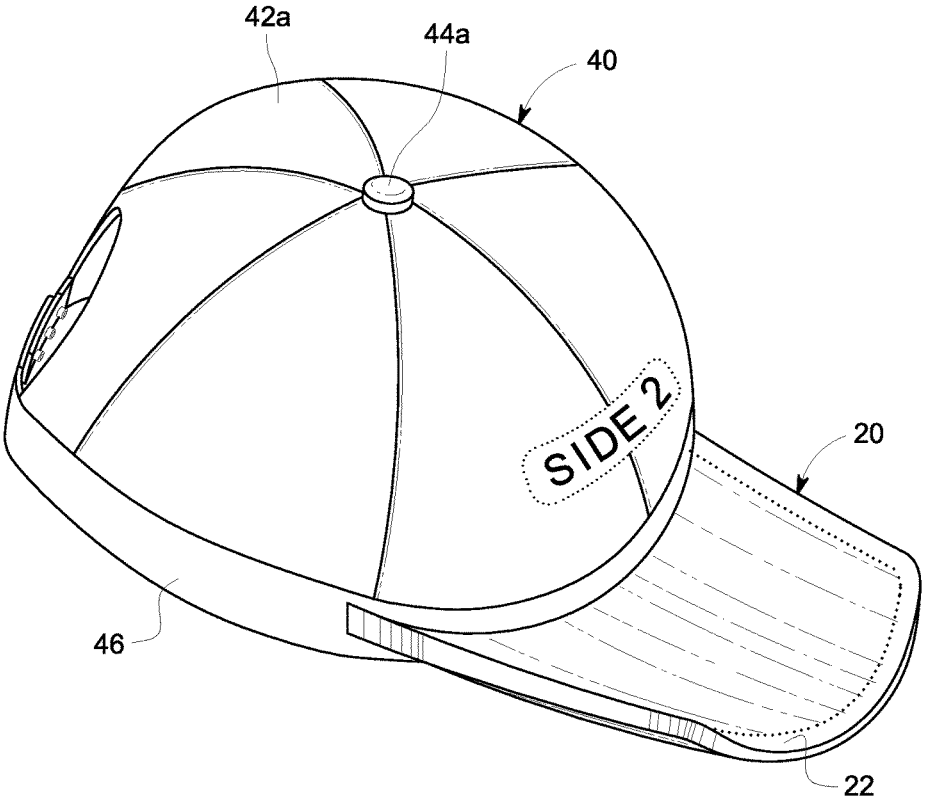
FIG. 3 illustrates an isometric view of the present invention wherein cap crown assembly 40 is now in the fully reversed position showing side 2 (side of cap crown assembly 40 opposite of original side 1 exposed in FIGS. 1 through 2A). Brim assembly 20 has still not been reversed.

Referring now to the drawings, where the present invention is generally referred to with numeral 10, it can be observed that it basically includes brim assembly 20, cap crown assembly 40, and reinforcement assembly 60. As shown in FIGS. 1 through 3, brim assembly 20 is securely mounted to cap crown assembly 40.

Figure 4:
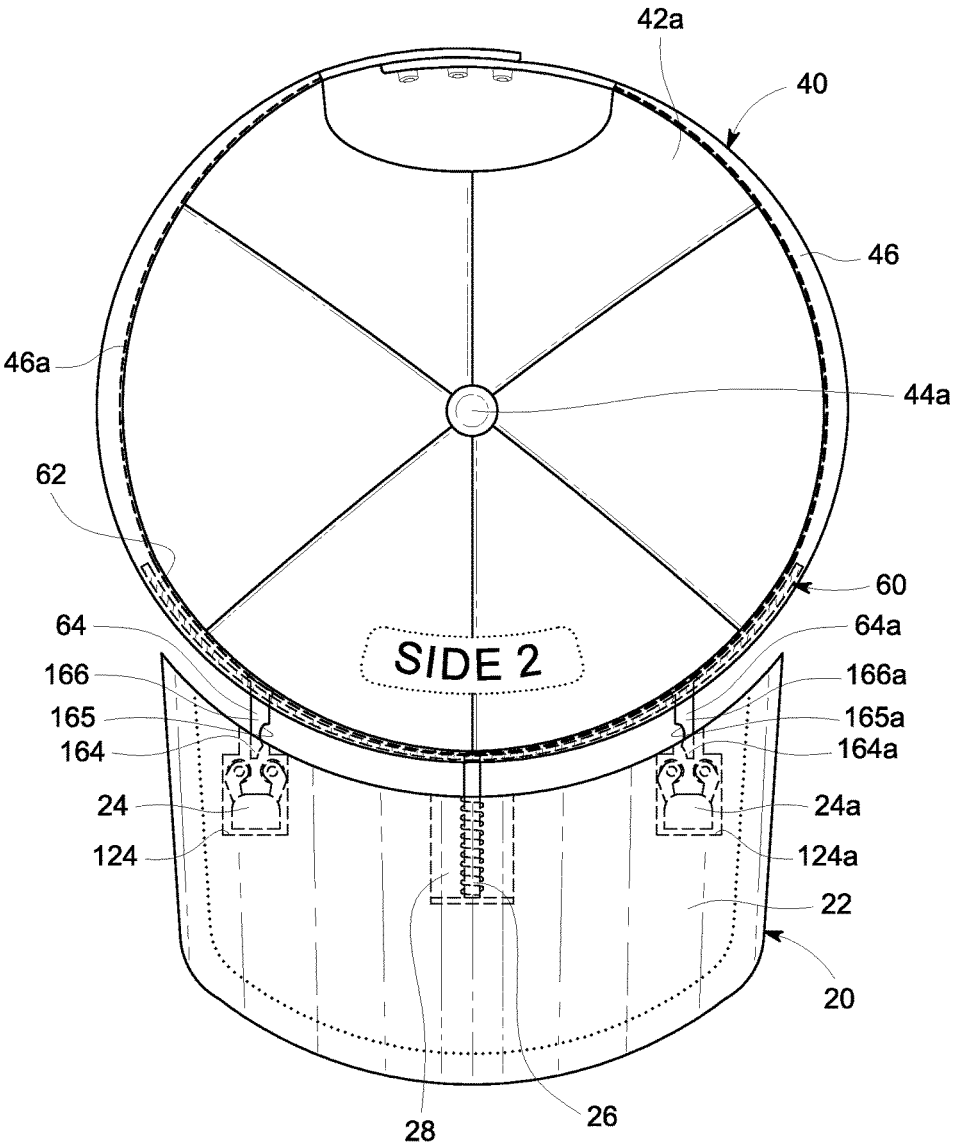
FIG. 4 is a representation of a partially see-through, top view of the present invention wherein brim assembly 20 has not yet been reversed and cap crown assembly 40 has been fully reversed. A partially see-through representation of brim assembly 20 is shown wherein anchoring member 24; 24*a* are mounted within said brim assembly 20 at a predetermined distance opposite each other. Additionally, spring-loaded pin 26 is seen mounted within brim assembly 20 and between anchor member 24; 24*a*. A partially see-through representation of reinforcement assembly 60 is also shown having reinforcement member 62 mounted therein along a predetermined distance of the circumference of cap crown assembly 40. Also shown are adjustable locking pins 64; 64*a* mounted to reinforcement member 62 and extending into anchoring members 24; 24*a*, respectively, thereby creating a secure engagement.
Figure 12:
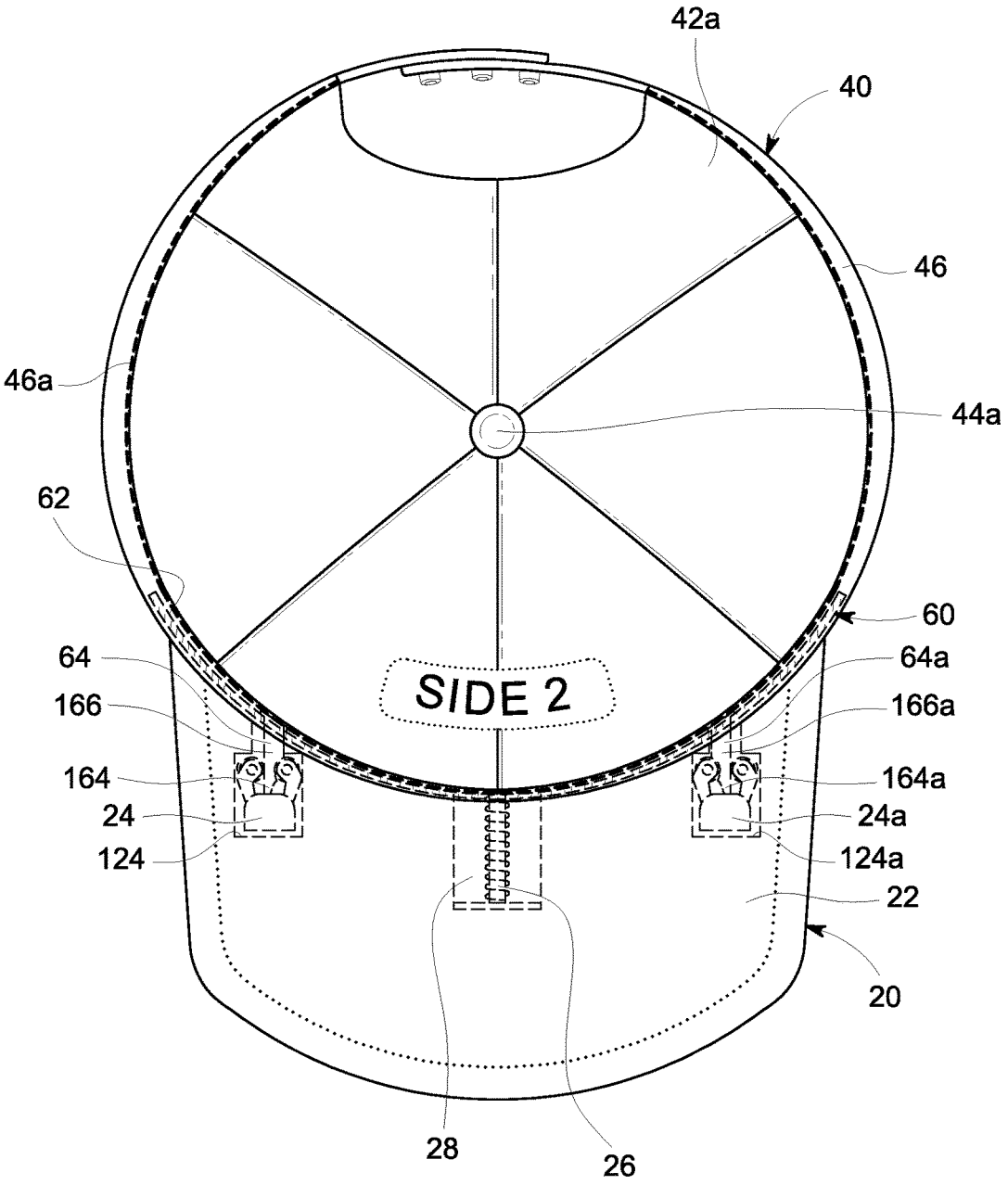
FIG. 12 is a partial see-through top view of the present invention wherein brim assembly 20 has been released so that locking pins 64; 64*a* are allowed to engage anchoring members 24; 24*a*, respectively, thereby finishing the reversal process.
Figure 13:
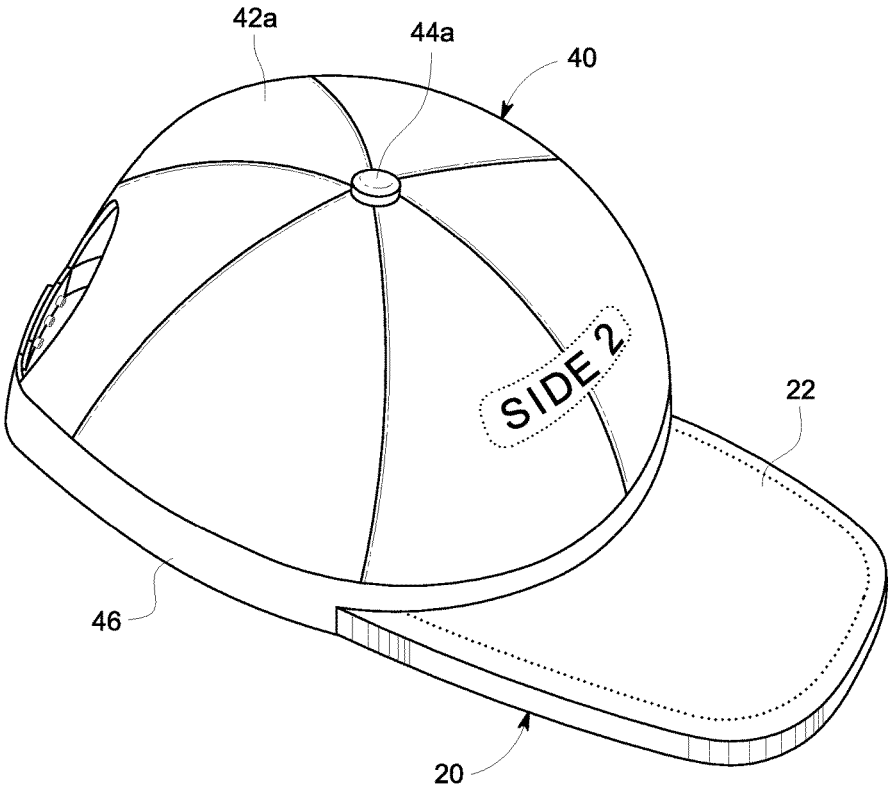
FIG. 13 is an isometric view of the present invention wherein cap crown assembly 40 and brim assembly 20 are in the fully reversed position and brim 22 has a flat configuration.
Figure 14:
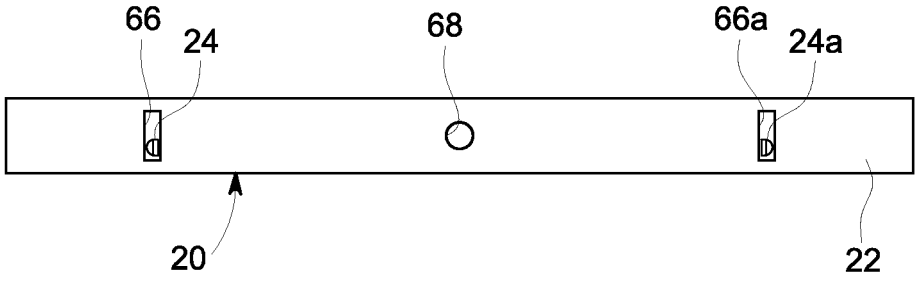
FIG. 14 is a rear elevational view of brim 22 having a flat configuration and completely removed from cap crown assembly 40, for illustration purposes, showing locking pin slots 66; 66*a* (having anchoring members 24; 24*a* mounted therein) and spring-loaded pin opening 68.
Figure 16:
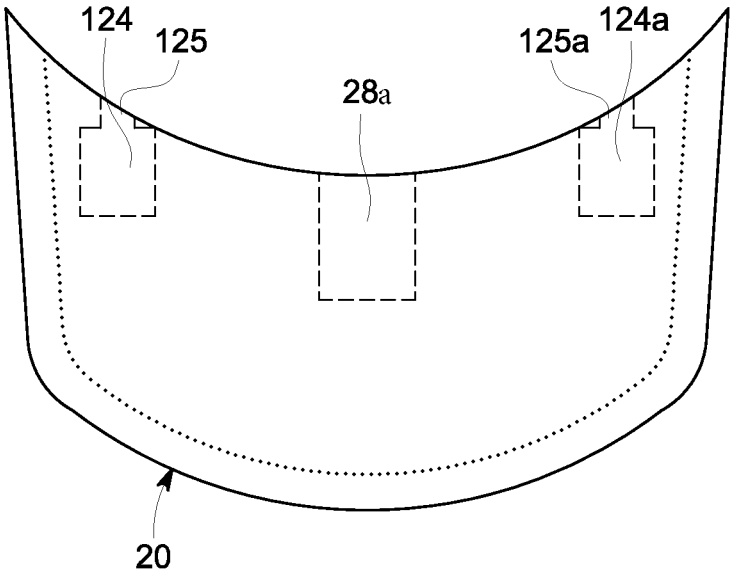
FIG. 16 illustrates a see-through top view of brim assembly 20 showing cavities 124; 124*a* where anchoring members 24; 24*a* are journaled. Channels 125; 125*a* are shown extending from cavities 124; 124*a*, respectively, thereby allowing anchoring members 24; 24*a* to enter cavities 124; 124*a*. Spring loaded pin housing 28*a* is also shown, wherein spring-loaded pin 26 (not shown) is journaled.

As seen in FIG. 4, brim assembly 20, having brim 22 being preselectively hollow to include an interior space wherein anchoring members 24; 24*a* are mounted within cavities 124; 124*a*, shown in FIGS. 4 and 16. In a preferred embodiment, cavities 124; 124*a* and complementing anchoring members 24; 24*a* are positioned adjacent to the left and right distal ends of the rear of brim 22. As shown in FIGS. 14 and 16, cavities 125; 125*a* are connected to slot openings 66; 66*a* through channels 125; 125*a*. Brim assembly 20 further includes spring-loaded pin 26 journaled within spring loaded pin housing 28*a* and mounted to reinforcement assembly 60 by being passed through opening 68 and locked in place at the rear of reinforcement assembly 60 using locking member 28, as shown in FIGS. 4, 12, and 16. Brim 22 can have a curved configuration as seen in FIG. 2 or a flat configuration as show in FIG. 13.

Figure 15:
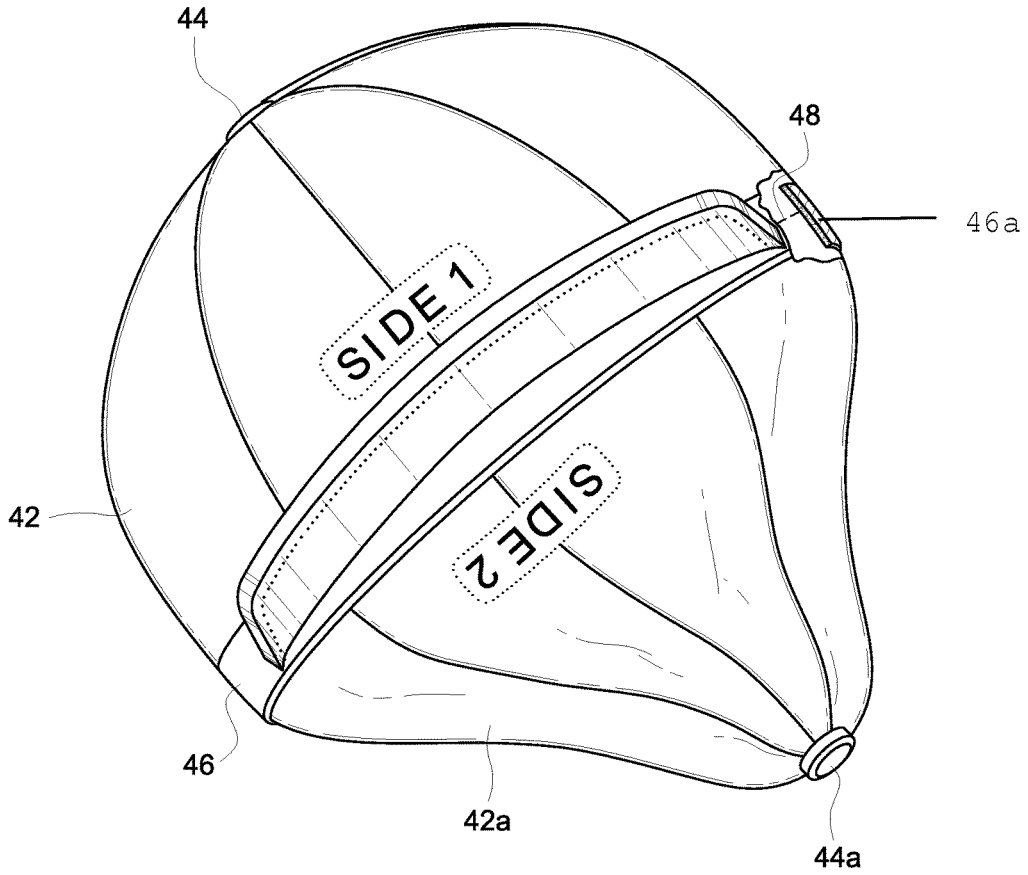
FIG. 15 shows an isometric view of the present invention showing first crown portion 42, having top button 44, pulled away opposite of second crown portion 42*a* having top button 44*a*. First and second crown portions 42; 42*a* are stitched along longitudinal midpoint 48, which extends around the circumference of band 46.

As shown in FIG. 15, cap crown assembly 40 can include first cap crown portion 42 and second cap crown portion 42*a*, having top buttons 44 and 44*a* respectively mounted to their top distal ends. First and second cap crown portions 42; 42*a* are shown pulled apart in FIG. 15 but one would be tucked into the other in its operating environment. Cap crown assembly 40 includes band 46 that extends along the outer circumference of the hat and inner band 46*a* that extends along the inner circumference of the hat. The bottommost distal ends (opposite top buttons 44; 44*a*) of first and second cap crown portions 42; 42*a* are stitched at and along midpoint 48 of inner band 46*a* so that an equal amount of each is revealed when configured to be used in either side. Optionally, only one cap crown portion can be used and in a preferred embodiment has its bottommost distal end stitched to midpoint 48.

Reinforcement assembly 60 is mounted between inner band 46*a* and outer band 46 and includes reinforcement member 62 extending along a predetermined circumference, as seen in FIGS. 4 and 12. Reinforcement member 62 provides stability to cap crown assembly 40 so that brim assembly 20 can easily be pulled away and retracted while keeping locking pins 64; 64*a* in a cooperative location with respect to anchoring members 24; 24*a*, respectively.

As shown in FIGS. 4 and 14, reinforcement assembly 60 further includes locking pins 64; 64*a* mounted at a predetermined distance apart from each other along reinforcement member 62. Locking pins 64; 64*a* are mounted at a position whereby they can effectively be simultaneously passed through openings 66; 66*a* and inserted into anchoring members 24; 24*a*, respectively. In a preferred embodiment, seen in FIGS. 4 and 11, locking pins 64; 64*a* include large portions 166; 166*a* and small portions 164; 164*a* spaced apart by cutouts 165; 165*a*. Small portions 164; 164*a* are inserted into anchoring members 24; 24*a*, respectively, which engages cutouts 165; 165*a* creating a secure engagement between anchoring members 24; 24*a* and locking pins 64; 64*a*, as seen in FIG. 12. In a preferred embodiment, reinforcement member 62 is made of a semi-rigid material allowing it to bend throughout a preselected distance of band 46.

Figure 14A:
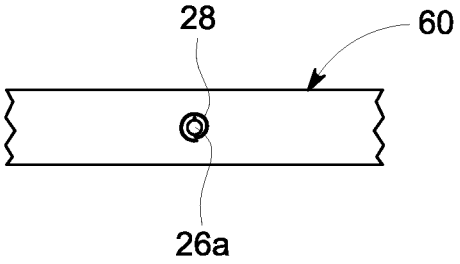
FIG. 14A is a partial rear elevational view of reinforcement assembly 60 showing spring-loaded pin distal end 26*a* mounted to reinforcement assembly 60 using pin locking member 28.

As shown in FIG. 14*a*, spring-loaded pin distal end 26*a* protrudes through spring-loaded pin opening 68 and is locked in place using pin locking member 28. Pin locking member 28 can be a clamp member, a cap member, or any other component capable of performing the same or similar function.

Figure 5:
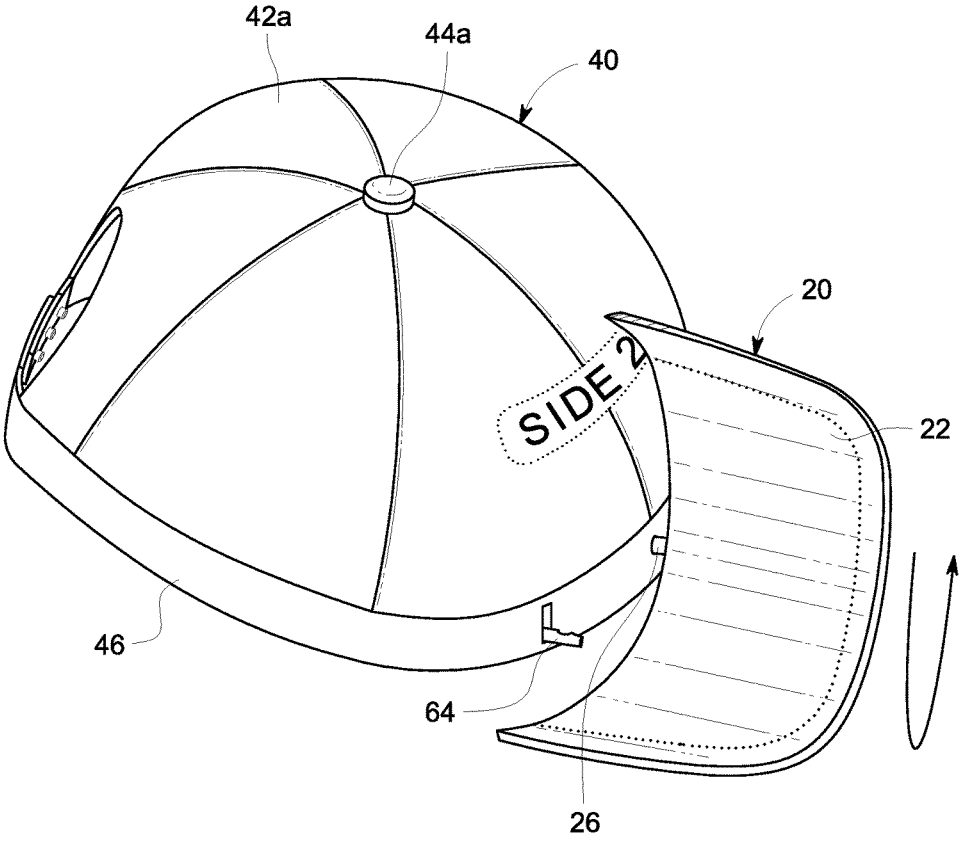
FIG. 5 shows cap crown assembly 40 in the fully reversed position and brim assembly 20 rotating about spring-loaded pin 26 when beginning its reversal process.
Figure 5A:
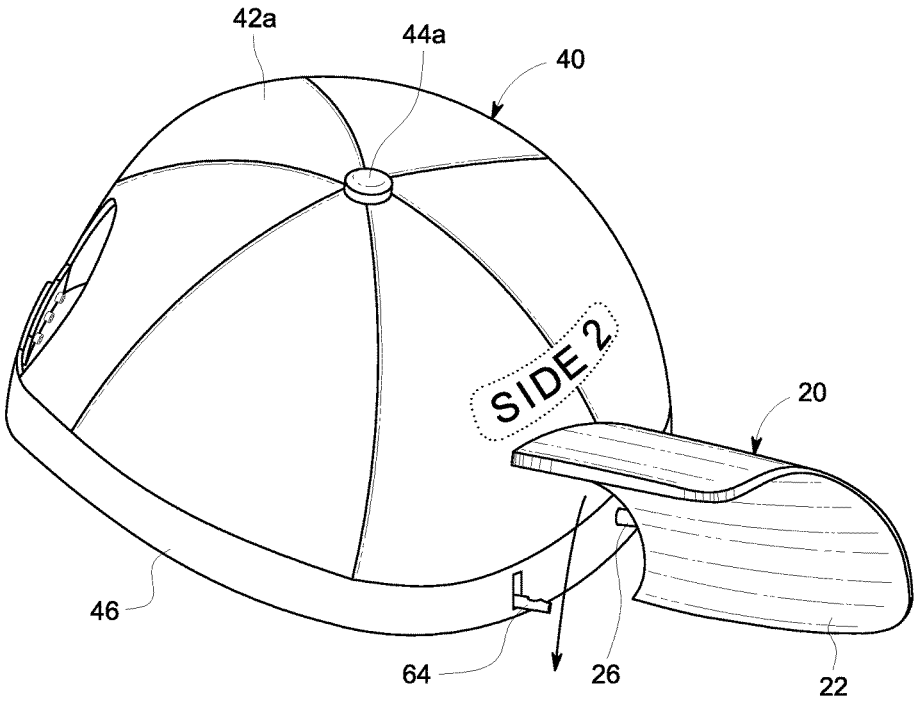
FIG. 5A shows brim assembly 20 finishing its reversal process and cap crown assembly 40 is completely reversed.
Figure 6:
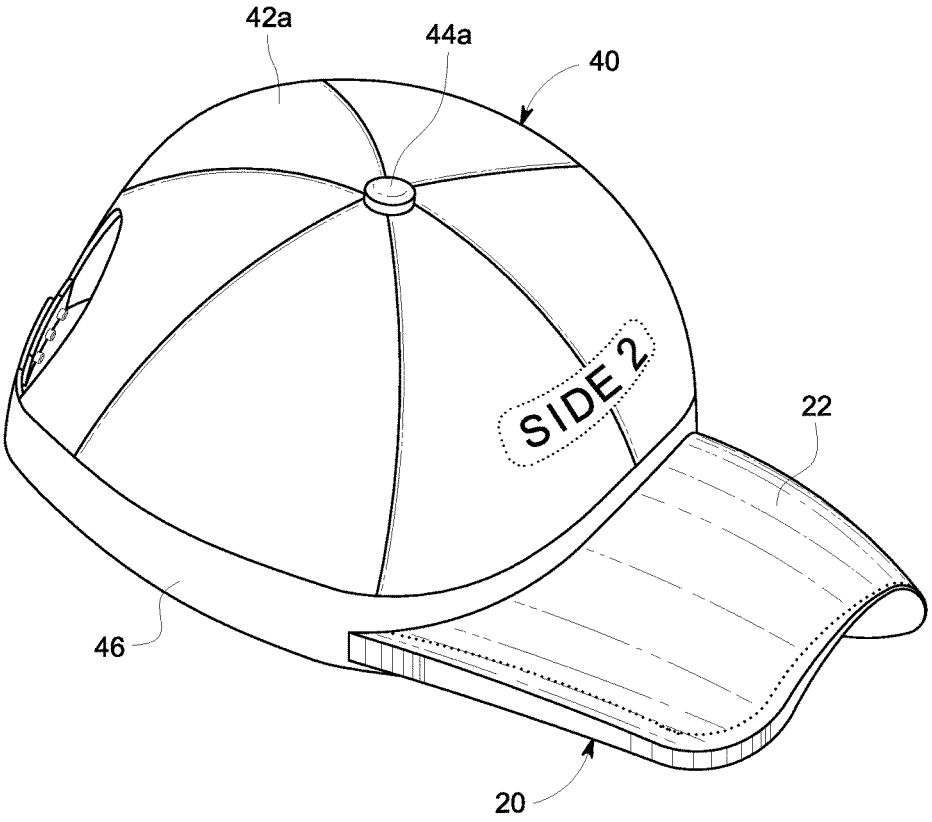
FIG. 6 is a representation of an isometric view of the present invention wherein brim assembly 20 and cap crown assembly 40 are in the completely reversed position.
Figure 7:
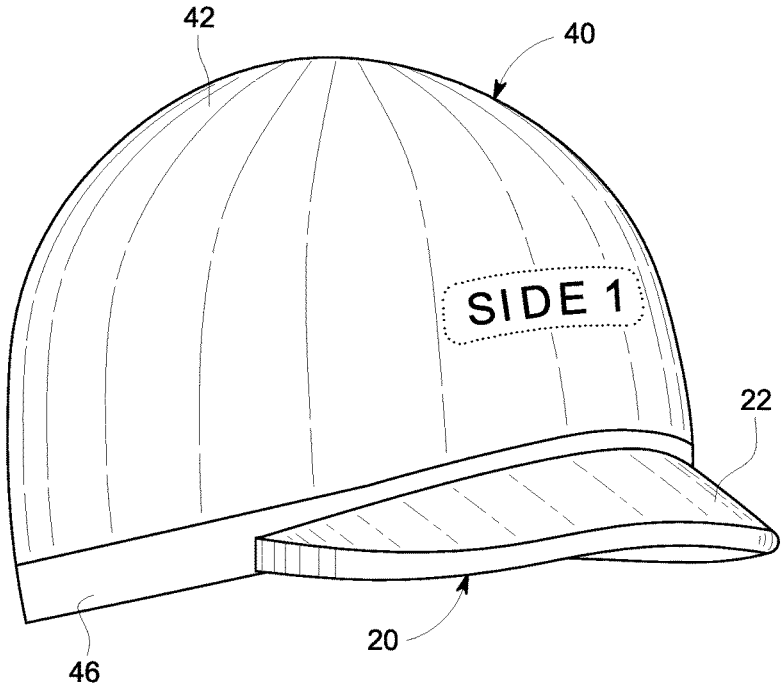
FIG. 7 is an isometric view of an alternate embodiment wherein the present invention is a beanie having brim assembly 20 and cap crown assembly 40.
Figure 7A:
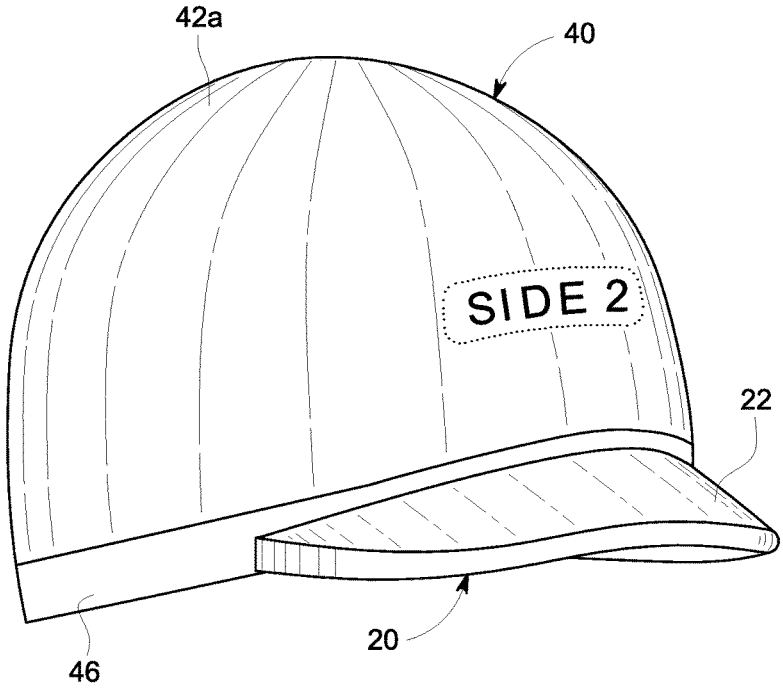
FIG. 7A is an isometric view of an alternate embodiment subject of FIG. 7 in the reversed position.
Figure 8:
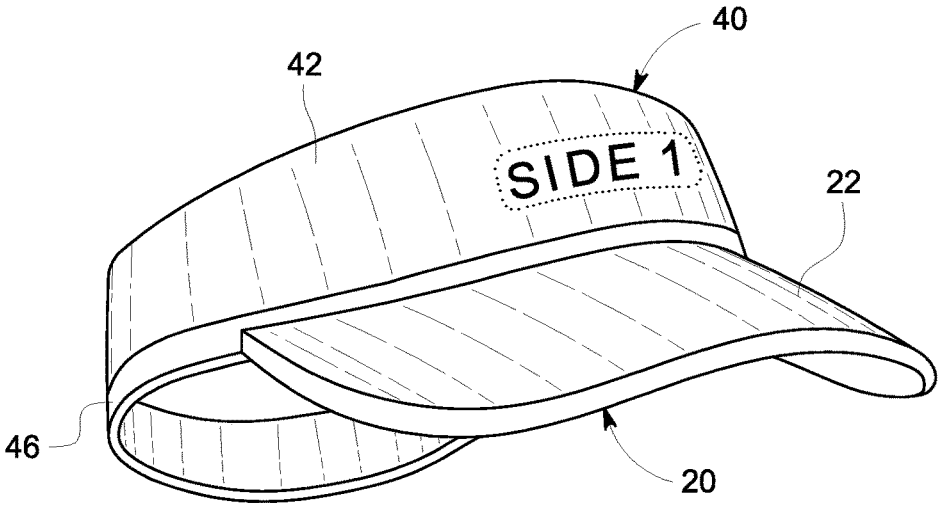
FIG. 8 is an isometric view of an alternate embodiment wherein the present invention is a visor-type headgear.
Figure 8A:
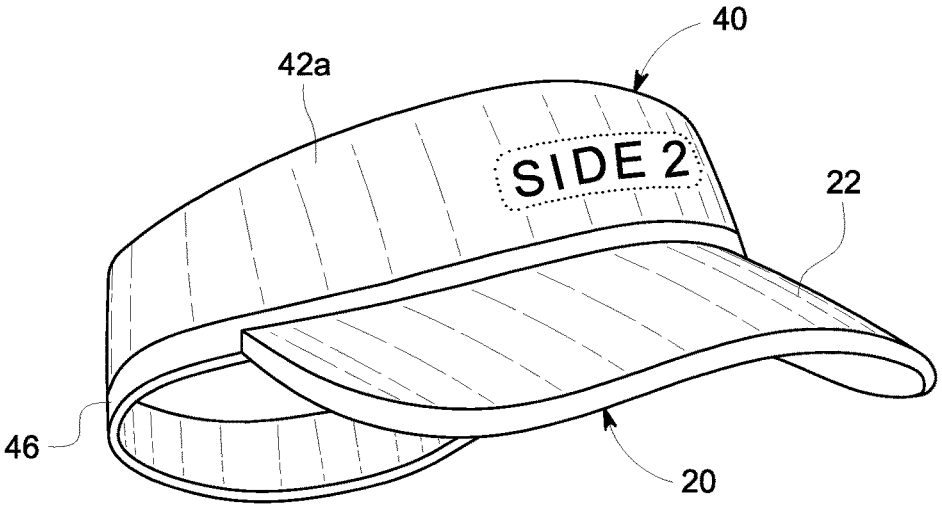
FIG. 8A is an isometric view of an alternate embodiment wherein the present invention is a visor-type headgear in the reversed position.
Figure 9:
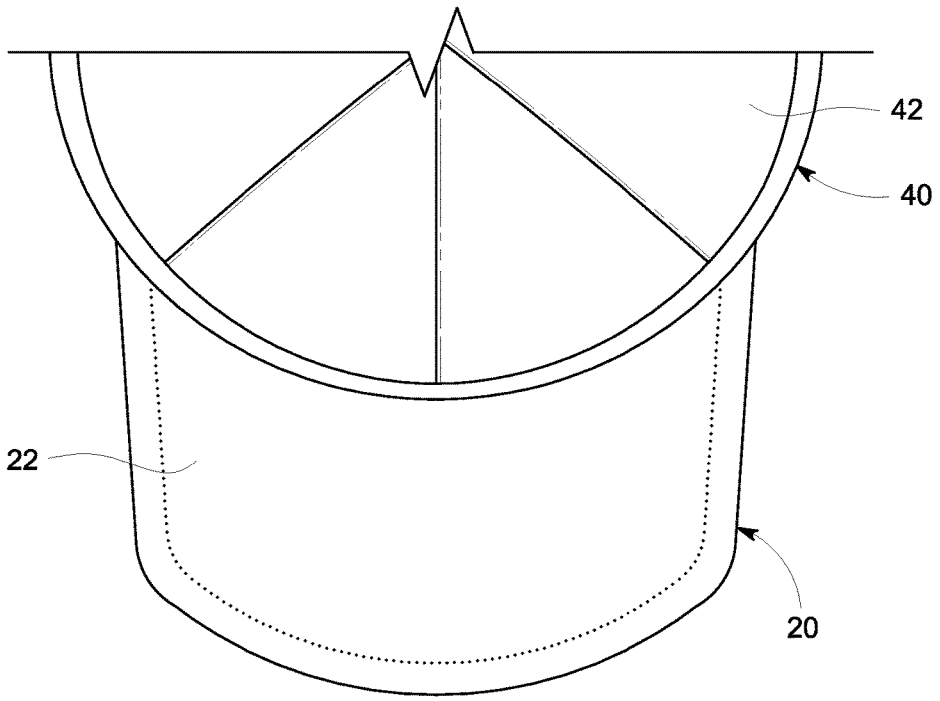
FIG. 9 represents a top partial view of the present invention showing brim assembly 20 mounted to cap crown assembly 40 wherein brim assembly 20 has a flat configuration.
Figure 10:
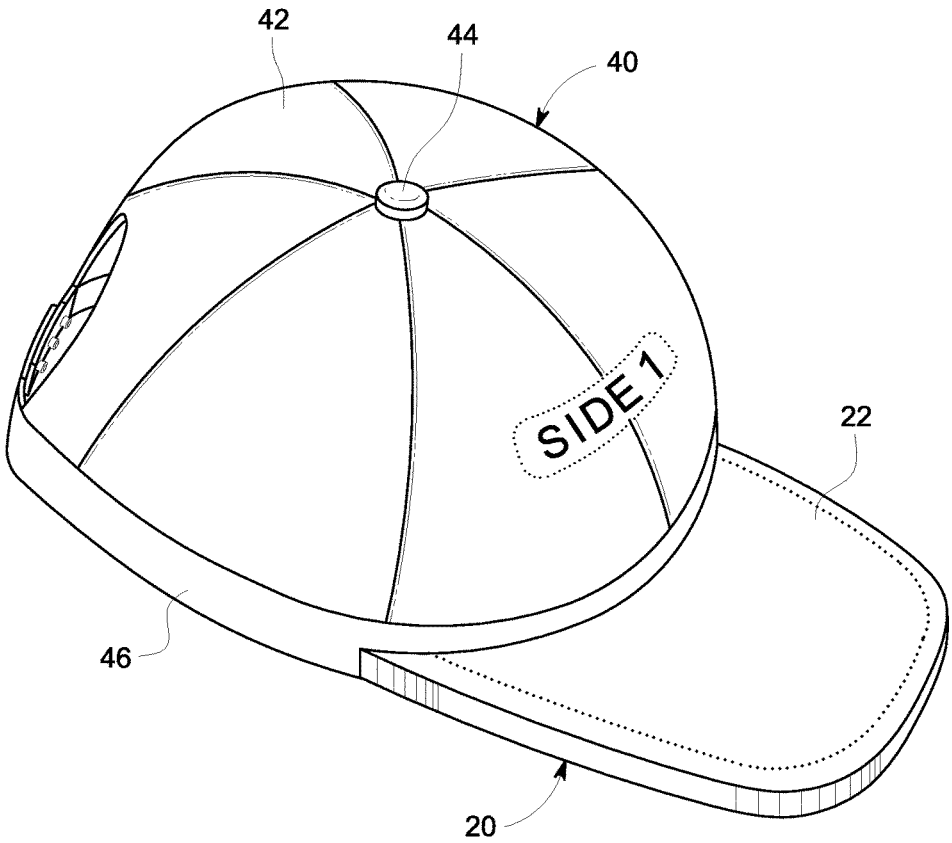
FIG. 10 shows an isometric view of the present invention wherein brim assembly 20 has a flat configuration.

When a user desires to reverse the cap he/she can either first reverse cap crown assembly 40 or brim assembly 20. To reverse cap crown assembly 40 a user simply pushes it towards its opposite position until side 2 is visible and sufficiently exposed. The user then pulls brim 22 away from cap crown assembly 40 with sufficient force to overcome the bias from spring-loaded pin 26, as shown in FIG. 4, to release locking pins 64; 64*a* from anchoring members 24; 24*a*, respectively. As shown in FIGS. 5, 5A, and 6, a user then rotates brim 22 in a counterclockwise or clockwise direction while continuing to pull it away from cap crown assembly 40 until brim 22 reaches the desired reversed position that complements the reversed side of cap crown assembly 40.

Figure 11:
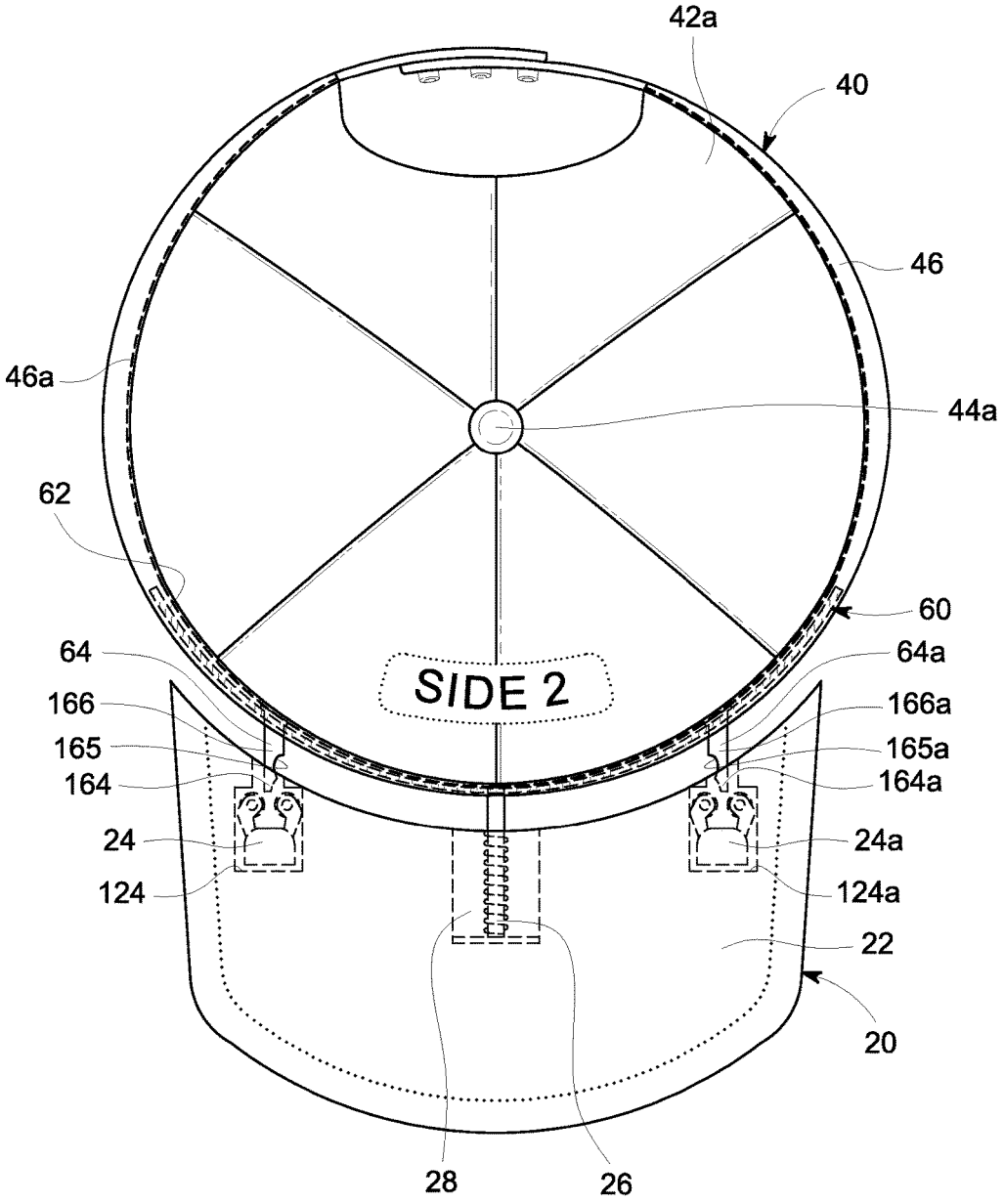
FIG. 11 shows a top view of the present invention wherein brim assembly 20 has been sufficiently pulled away from cap crown assembly 40 so that the bias from spring-loaded pin 26 is overcome and locking pins 64; 64*a* are detached from anchoring members 24; 24*a* in preparation for the reversal process.

When brim 22 is in the proper reversed position with respect to cap crown assembly 40 the user then releases brim 22 to allow the bias of spring-loaded pin 26 to retract it back towards cap crown assembly 11, as shown in FIGS. 11 and 12. The user should ensure that locking pins 64; 64*a* are lined up with channels 125; 125 to allow them to pass into cavities 124; 124*a* where they will be received by anchoring members 124; 124*a*. This completes the reversal process and the same steps can be repeated to bring the cap back to its original position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A reversible cap comprising:

a brim assembly having a periphery including a proximal and distal ends, said brim assembly including a left and right distal ends; a first, second and third housings disposed within and adjacent to sais proximal end; said first housing and said second housing located at said left and right distal ends, respectively; said first and second housings each including an anchoring member, said third housing including a spring-loaded pin; a cap crown assembly attached to said brim assembly along said proximal end using said spring-loaded pin, and two fastening members extending from said cap crown assembly and adapted to engage to each individual said anchoring member; and said brim assembly capable of being pulled apart from said cap crown assembly to overcome the bias of said spring-loaded pin thereby releasing said fastening members from said anchoring members to allow said brim assembly to rotate to a desired position, said brim assembly released when said desired position is reached and the bias of said spring-loaded pin urges said fastening members back into said anchoring members to create a secure engagement between said brim assembly and said cap assembly.

2. The reversible cap subject of claim 1 wherein said cap crown includes bottom and top end, said top end having a top button thereon.

3. The reversible cap subject of claim 1 wherein said cap crown and said brim assembly have the configuration of a visor-type headgear.

4. The reversible cap subject of claim 1 wherein said cap crown and said brim assembly have the configuration of a beanie-type headgear.

5. The reversible cap subject of claim 1 wherein said inner band includes a longitudinal midpoint that extends along the entire circumference of said cap crown, said cap crown assembly's bottom end being mounted along said longitudinal midpoint.

6. The reversible cap subject of claim 5 wherein said cap crown assembly includes a second cap crown mounted to said longitudinal midpoint and tucked flush against said first cap crown.

7. The reversible cap subject of claim 1 wherein at least one of said fastener members are two locking pins that cooperate with said anchoring members.

8. The reversible cap subject of claim 1 wherein said brim assembly includes said left and right distal ends, said first housing located at said left distal end and said second housing located at said right distal end, said third housing located between said first and second housings.

9. The reversible cap subject of claim 8 wherein said third housing is located at the midpoint between said right and left distal ends.

10. The reversible cap subject of claim 8 wherein a second cap crown assembly is mounted flush within said first cap crown.

11. The reversible cap subject of claim 10 wherein first and second cap crowns include a top button.

12. The reversible cap of claim 1 wherein a third housing is added and houses a second anchoring member.

13. The reversible cap of claim 1 wherein an outerband extends along an outer circumference of said cap crown assembly.

14. A reversible cap comprising: a brim assembly being attached to a cap crown assembly said brim assembly having a periphery including a proximal and distal ends, said brim assembly including a left and right distal ends; a first, second and third housings disposed within and adjacent to said proximal end; said first housing including a first anchoring member and said second housing including a second anchoring member located at said left and right distal ends, respectively; said cap crown assembly having a first cap crown, a front side, a bottom end, an inner band extending along an inner circumference of said first cap crown and an outer band extending along an outer circumference of said firs cap crown, said proximal end of said brim assembly attached to said cap crown assembly, said three housings each having a channel that extends to openings at said proximal end of said brim assembly, said inner band having a longitudinal midpoint that extends along said inner circumference, said cap crown assembly's bottom end mounted along said midpoint, said third housing including a spring-loaded pin between said first and second housings, a reinforcement assembly extending partially along said cap crown assembly's front side between said inner and outer bands and further including locking pins positioned at a location on said reinforcement assembly and adapted to engage said anchoring members to create a secure engagement, wherein said reinforcement member further including an opening that cooperates with said spring-load pin to allow said spring-loaded pin to pass through said opening and be attached to said reinforcement assembly using a locking member;

wherein said brim assembly capable of being pulled apart from said cap crown to overcome the bias of said spring-loaded pin thereby releasing said fastening members from said anchoring members to allow said brim assembly to rotate to a desired position, said brim assembly released when said desired position is reached and the bias of said spring-loaded pin urges said fastening members back into said anchoring members to create a secure engagement between said brim assembly and said cap assembly.

15. The reversible cap subject of claim 14 wherein said cap crown and said brim assembly have the configuration of a visor-type headgear.

16. The reversible cap subject of claim 14 wherein said cap crown and said brim assembly have the configuration of a beanie-type headgear.

17. The reversible cap of claim 14 wherein said locking pins are adjustable.

18. A brim assembly being attached to cap crown assembly having three housings; said brim assembly having a periphery including a proximal and distal ends, said brim assembly including a left and right distal ends; said three housings disposed within and adjacent to said proximal end; two of said three housings including anchoring members located on said left and right distal ends; and one of said three housings including a spring-loaded pin, wherein said cap crown assembly attached to said brim assembly along said proximal end using said spring-loaded pin;

wherein said cap crown assembly having a first cap crown, an inner band extending entirely along an inner circumference of said cap crown, an outer band extending entirely along an outer circumference of said cap crown, said spring-loaded pin being substantially perpendicular to said outer band, and a reinforcement assembly extending at least partially between said inner and outer band, said reinforcement assembly having at least one fastening member extending towards said brim assembly, said brim assembly being able to be pulled apart from said cap crown to overcome the bias of said spring-loaded pin thereby releasing said fastening member from said anchoring member to allow said brim assembly to rotate to a desired position, said brim assembly released when said desired position is reached and the bias of said spring-loaded pin urges said locking pin back into said anchoring member to create a secure engagement.

* * * * *